US011807001B2

(12) United States Patent
Linn et al.

(10) Patent No.: US 11,807,001 B2
(45) **Date of Patent: *Nov. 7, 2023**

(54) RESET MONITOR

(71) Applicant: HEWLETT-PACKARD DEVELOPMENT COMPANY, L.P., Spring, TX (US)

(72) Inventors: Scott A. Linn, Corvallis, OR (US); James M. Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/950,412

(22) Filed: Sep. 22, 2022

(65) Prior Publication Data

US 2023/0012508 A1 Jan. 19, 2023

Related U.S. Application Data

(63) Continuation of application No. 16/957,518, filed as application No. PCT/US2019/016749 on Feb. 6, 2019, now Pat. No. 11,498,328.

(51) Int. Cl.
*B41J 29/393* (2006.01)
*B41J 2/045* (2006.01)

(52) U.S. Cl.
CPC ..... *B41J 2/04586* (2013.01); *B41J 2/04541* (2013.01); *B41J 2/04573* (2013.01); *B41J 29/393* (2013.01)

(58) Field of Classification Search
CPC ... B41J 29/393; B41J 2/04541; B41J 2/04586
See application file for complete search history.

(56) References Cited

U.S. PATENT DOCUMENTS

| | | | | |
|---|---|---|---|---|
| 5,398,332 | A * | 3/1995 | Komoda | G06F 11/076 714/E11.004 |
| 6,493,109 | B1 | 12/2002 | Takamura et al. | |
| 6,580,520 | B1 | 6/2003 | Teradaira et al. | |
| 9,524,132 | B2 | 12/2016 | Weaver et al. | |
| 9,698,771 | B1 | 7/2017 | Srinivasan et al. | |
| 2002/0024545 | A1 | 2/2002 | Watanabe | |
| 2008/0106757 | A1 | 5/2008 | Asauchi | |
| 2017/0351564 | A1 | 12/2017 | Tsujiguchi | |
| 2018/0079207 | A1 | 3/2018 | Hiyoshi et al. | |

FOREIGN PATENT DOCUMENTS

| | | | |
|---|---|---|---|
| CN | 101093243 | A | 12/2007 |
| CN | 101522428 | A | 9/2009 |
| CN | 104354473 | A | 2/2015 |
| DE | 69927755 | T2 | 7/2006 |
| EP | 0962322 | A1 | 12/1999 |
| EP | 0976568 | A2 | 2/2000 |

* cited by examiner

*Primary Examiner* — Lam S Nguyen
(74) *Attorney, Agent, or Firm* — Foley & Lardner LLP

(57) ABSTRACT

An integrated circuit for a fluid ejection device having actuators to operate during a non-reset operating condition is disclosed. The integrated circuit includes a reset input to receive a reset signal activated for a duration. The reset signal generates a reset condition in the integrated circuit. The integrated circuit also includes a monitor circuit operably coupled to the reset input to indicate if the duration of the reset signal meets or exceeds a selected duration and a nonvolatile memory device having data accessible during the reset condition.

18 Claims, 2 Drawing Sheets

RESET MONITOR

CROSS-REFERENCE TO RELATED APPLICATIONS

This application is a continuation of U.S. application Ser. No. 16/957,518, filed on Jun. 24, 2020, and titled RESET MONITOR, which is a U.S. National Stage Application of International Application No. PCT/US2019/016749, filed Feb. 6, 2019, both of which are incorporated herein by reference.

BACKGROUND

Printing devices can include printers, copiers, fax machines, multifunction devices including additional scanning, copying, and finishing functions, all-in-one devices, or other devices such as pad printers to print images on three dimensional objects and three-dimensional printers (additive manufacturing devices). In general, printing devices apply a print substance often in a subtractive color space or black to a medium via a device component generally referred to as a printhead. Printheads can employ fluid actuator devices, or simply actuator devices, to selectively eject droplets of print substance onto a medium during printing. For example, actuator devices can be used in inkjet type printing devices. A medium can include various types of print media, such as plain paper, photo paper, polymeric substrates and can include any suitable object or materials to which a print substance from a printing device are applied including materials, such as powdered build materials, for forming three-dimensional articles. Print substances, such as printing agents, marking agents, and colorants, can include toner, liquid inks, or other suitable marking material that in some examples may be mixed with other print substances such as fusing agents, detailing agents, or other materials and can be applied to the medium.

DETAILED DESCRIPTION

Figure 1:
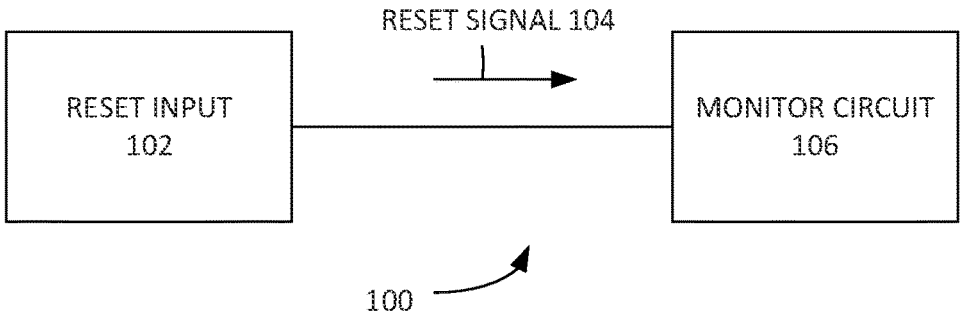
FIG. 1 is a block diagram illustrating an example integrated circuit, which can be used to drive a plurality of actuators.

An inkjet printing system, which is an example of a fluid ejection system, can include a printhead, a print substance supply, and an electronic controller. The printhead, which is an example of a fluidic actuator device or actuator device, can selectively eject droplets of print substance through a plurality of nozzle assemblies, each of which can be an example of an actuator, onto a medium during printing. The nozzles of the nozzle assemblies can be arranged on the printhead in a column or an array and the electronic controller can selectively sequence ejection of print substance. The printhead can include hundreds or thousands of nozzles, and each nozzle ejects a droplet of print substance in a firing event in which electrical power and actuation signals are provided to printhead. In one example, a printhead can correspond with a color or print substance on the printing system. A printing system employing a subtractive color can include a printhead corresponding with a cyan print substance, a printhead corresponding with a magenta print substance, a printhead corresponding with a yellow print substance, and a printhead corresponding with a black, or key, print substance.

In order to eject a print substance from an actuator, the actuator can be loaded with the corresponding print substance and supplied with electrical power and actuation signals to select activation of the actuator. The firing event is triggered when a fire signal is applied to the loaded actuator to eject the print substance. The actuators are subjected to a sequence of firing events with a sequence of fire signals applied to the printhead as the printhead is moved relative the medium during printing. Firing events can be triggered during a non-reset operating condition of the printhead. During the non-reset operating condition, the printhead can function in a regular operating mode.

From time to time, the printhead can be reset or restarted with a reset signal. In one example, the reset signal is provided to the printhead from an external source such as the electronic controller. The reset signal is activated for a duration, received by reset logic on the printhead to generate a reset condition in the printhead. During the reset condition, the non-reset operating condition is blocked, and the fire signal is not provided to the actuators. No firing events are triggered during the reset condition. Reset conditions can be triggered for a number of reasons including if there is a power outage, an error occurs in the printhead or the electronic controller, the printing device is out of medium, or the printhead is out of print substance.

A reset condition can include processes that may be executed in varying periods of time. During the reset condition, a register may be reset relatively quickly, but data to be read from a memory may take more time. For example, the printhead can include a non-volatile memory array storing data that is used to configure the printhead during the reset condition or other modes of operation. The data stored in the non-volatile memory array, in one example, can be read during the reset condition but is not accessible during the non-reset operating condition. A bias current to read the data may take time to reach operating level, and there is a minimum time for the reset condition so that the read of the data can be considered completed before the data is captured into a holding latch or flop for later use.

This disclosure is directed to a circuit to determine whether a reset condition has occurred for a selected period of time, which allows time for operations that occur during the reset condition to be completed before the printhead exits the reset condition and returns to the non-reset operating condition. The circuit is configured to determine whether a reset signal provided to the integrated circuit has been in an active state for the selected period of time, or activated for a selected duration. In one example, if the reset signal remains activated for longer than a selected amount of time, the circuit can provide a reset effective signal, which can be used to exit the reset condition or start the non-reset operating condition. If the reset signal is activated for less than the selected amount of time, the circuit will not provide a reset effective signal.

FIG. 1 illustrates an example integrated circuit 100 to drive a plurality of actuators during a non-reset operating condition. The actuators can eject a fluid, such as a print substance, in a firing event that is in response to a fire signal. The firing event can occur during the non-reset operating condition. The integrated circuit 100 includes a reset input 102 to receive a reset signal 104 activated for a duration. In one example, the reset signal 104 is received from an external source, such as an electronic controller, which provides the reset signal 104 to the reset input 102. The reset input 102 can be configured as an electrical connection such as a conductive pad. The reset signal 104 generates a reset condition in the integrated circuit 100 during which the non-reset operating condition is blocked. For example, the fire signal is prevented from reaching the actuators during the reset condition. The integrated circuit 100 also includes a monitor circuit 106 operably coupled to the reset input 102 to indicate if the duration of the reset signal 104 meets or exceeds a selected duration. If the duration that the reset signal 104 is activated meets or exceeds the selected duration, the monitor circuit 106 can provide a reset effective signal to indicate to the integrated circuit 100 that the reset condition was for an effective period of time and the non-reset operation condition can resume. In one example, the non-reset operating condition can begin if the reset signal is deactivated and the reset effective signal is activated. If the duration that the reset signal 104 was activated is less than the selected duration, the monitor circuit 106 does not provide a reset effective signal. In one example, the non-reset operating condition remains blocked if the reset effective signal is deactivated, and another reset signal is received to generate a reset condition.

Figure 2:
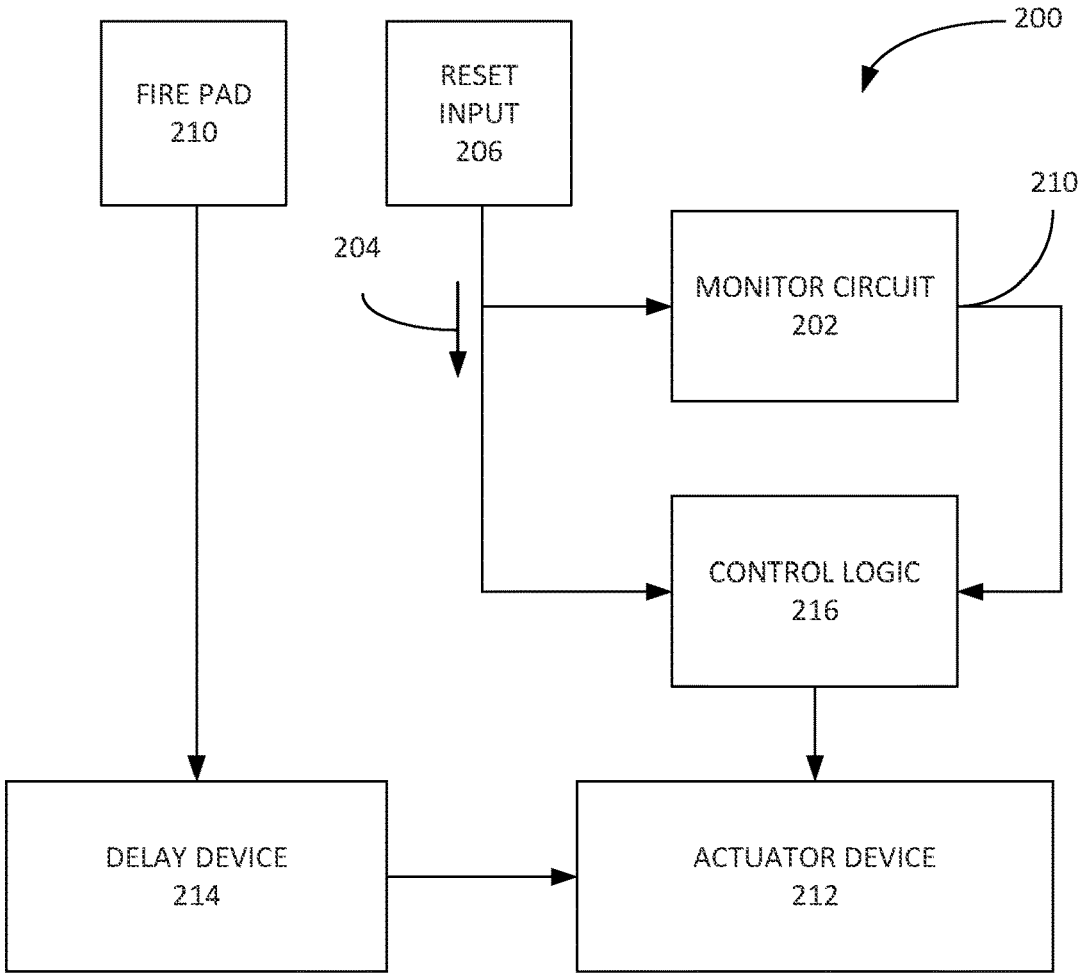
FIG. 2 is a block diagram illustrating an example fluid ejection device that can include the example integrated circuit of FIG. 1.

FIG. 2 illustrates an example of an integrated circuit 200 that can be incorporated into a printhead and include features of the example integrated circuit 100. The integrated circuit 200 includes a monitor circuit 202 that can include a timer. The monitor circuit 202 can receive a reset signal 204 at reset input 206 and selectively provide a reset effective signal at reset effective signal output 208. The reset signal 204 can be applied to initiate a reset condition in the integrated circuit 200 with control logic 216. Control logic 216 can include configuration registers and other elements that can initiate a reset condition or a non-reset operating condition in the integrated circuit 200. In one example, an activated reset effective signal can be applied to terminate the reset condition and begin a non-reset operating condition via control logic 216. Monitor circuit 202 may be incorporated into control logic 216 in some examples. The reset signal 204 can be provided from an external source, such as an electronic controller operably coupled to the integrated circuit 200, to initiate the reset condition from a condition of the integrated circuit, such as the non-reset operating condition, an error condition, or a non-operating condition implemented with control logic 216. In one example, the reset signal 204 is activated with a waveform having a logic voltage, such as a logic low voltage between about 0.0 volts or a reference voltage such as GND, for a selected amount of time. The reset signal 204 can be deactivated with a logic voltage such as a logic high voltage of 1.8 volts to 15 volts. In another example, the reset signal 204 can be activated with a logic high voltage and deactivated with a logic low voltage. The reset effective signal can be activated with a logic voltage such as logic high and deactivated with a logic low.

The integrated circuit 200 is configured to drive a plurality of fluid actuators on actuator device 212 to eject a plurality of print substance droplets in response to a fire signal received at a fire input 210, such as a fire pad during the non-reset operating condition as provided by control logic 216. The integrated circuit 200 also includes a plurality of delay circuits on delay circuit device 214. Each of the delay circuits on delay circuit device 214 produces an output waveform similar to its input waveform but delayed by a selected amount of time. The plurality of delay circuits are coupled together in series on the delay circuit device 214. The delay circuit device 214 receives the fire signal from the fire input 210. Each of the of the delay circuits receives the fire signal in series, and after a delay, provides the fire signal via an output to a corresponding fluid actuator on the actuator device 212 trigger or actuate a firing event in the fluid actuators. For example, a delay circuit of the plurality of delay circuits is coupled in series to a successive delay circuit of the plurality of delay circuits. The delay circuit receives the fire signal, and after a local delay, provides the fire signal to a corresponding fluid actuator of the plurality of fluid actuators and to the successive analog delay circuit. The successive delay circuit receives the fire signal, and, after a local delay provides the fire signal to a corresponding fluid actuator of the plurality of fluid actuators. The delay circuits in the delay circuit device 214 can include digital circuits having flip-flops driven with a continuously running clock signal or analog delay elements receiving a bias current to affect the delay to stagger the firing events. The bias current can be used to finely adjust delay of the analog delay elements as well as adjust delay for various print speed modes of a printhead system.

In this example, the integrated circuit 200 staggers the firing events in the actuator device 212 from a single fire signal to reduce peak power consumption in the actuator device 212 during printing. Rather than simultaneously actuate hundreds or thousands of actuators in the printhead, the delay circuit device 214 may simultaneously actuate a dozen or so actuators in the actuator device 212. In one example, firing events in the actuator device 212 are staggered in the order of 100 nanoseconds apart with a fire signal having a duration of approximately one microsecond.

The integrated circuit 200 can include a fire signal detection circuit to detect an over-energizing condition in the actuator device 212, such as if the fire signal is unexpectedly activated, or held in a high state for longer than a predetermined duration, such as from a short circuit or another error on the printhead or in a circuit supplying the fire signal to the printhead. In one example, if the fire signal remains activated for longer than a selected amount of time, such as for longer than an expected amount of time to trigger a firing event, the fire signal detection circuit can disable the fire signal supplied to the actuator device 212 and, in some examples, notify the electronic controller of the printing system of a fault condition in the printhead. The fire signal detection circuit can include a blocking circuit to prevent the fire signal from reaching the delay circuit device 214 or the actuator device 212, and the blocking circuit can be activated in response to a timer to meter the predetermined duration. In one example, the timer is a relatively large analog circuit on the integrated circuit 200, which is configured to manage the fire signal detection circuit during the non-reset operating condition The monitor circuit 202 includes a timer that is started when a reset signal 204 is received, such as when the activated reset signal 204 is received at the reset input 206. The reset signal 204 is also provided to control logic 216 that can initiate the reset condition in the integrated circuit 200. If the reset signal 204 is deactivated after the timer expires at the selected duration, the monitor circuit 202 will output a reset effective signal at output 208, which can be used to initiate a non-reset operating condition. If, however, the reset signal 204 is deactivated prior to the expiration of the timer at the selected duration, the monitor circuit 202 does not generate the reset effective signal, or the reset effective signal remains deactivated, at output 208, and prevents the control logic 216 from initiating the non-reset operating condition. Accordingly, the delay circuit device 214 is unable to provide the fire signal 204 to the actuator device 212 to trigger a firing event.

The timer in the monitor circuit 202 can be configured to determine whether the reset signal 204 was activated long enough to enable the control logic 216 to perform a function in the reset condition. In one example, control logic 216 is operably coupled to a memory device 218, such as a non-volatile memory array storing configuration data that may be applied to configure the control logic 216 and integrated circuit 200 for the non-reset operating condition. The control logic 216 can access, such as read, the data in memory device 218 with a sense amplifier and a bias current, which may not be provided during the non-reset operating condition. The control logic 216 can read the data in memory device 218 during the reset condition, however, which can provide a relatively higher current to the memory device 218 than in the non-reset operating condition. In order to read the data in the memory device 218 during the reset state, the control logic can start a voltage or current regulator and receive the data from the memory device, which typically takes a predetermined period of time that can be affected by such factors as process, voltage, and temperature of the integrated circuit. The data in the memory device 218 is captured in a latch or flip-flop from which the data can be read after the integrated circuit 200 has transitioned back to a relatively lower current state. In the example, the process of starting the higher current state and receiving the data into the latch or flip-flop is performed while the reset signal is activated. The process may fail if the reset signal is deactivated prior to the data being captured in the latch or flip-flop. In one example, the timer in the monitor circuit 202 can be configured to determine whether the reset signal 204 was activated long enough to enable the control logic 216 to access the data in the memory device. In one example, the selected duration of the timer can be set to expire between 2.5 microseconds and 6.0 microseconds.

In one example, the timer in the monitor circuit 202 can be the same circuit as the timer used in the fire signal detection circuit. In one example, the selected duration of the timer in the monitor circuit is also the predetermined duration of a held high fire signal before it is blocked from the actuator device 212. Also, the timer in the monitor circuit 202 is used in the reset condition rather than the non-reset operating condition whereas the timer in the fire signal detection circuit is used in the non-reset operating condition rather than the reset condition. Accordingly, the functions of the timer in the monitor circuit 300 and the fire detection circuit are in mutually exclusive conditions. The use of the timer for multiple functions serves to save area on the integrated circuit 200 from having to duplicate large circuits.

Figure 3:
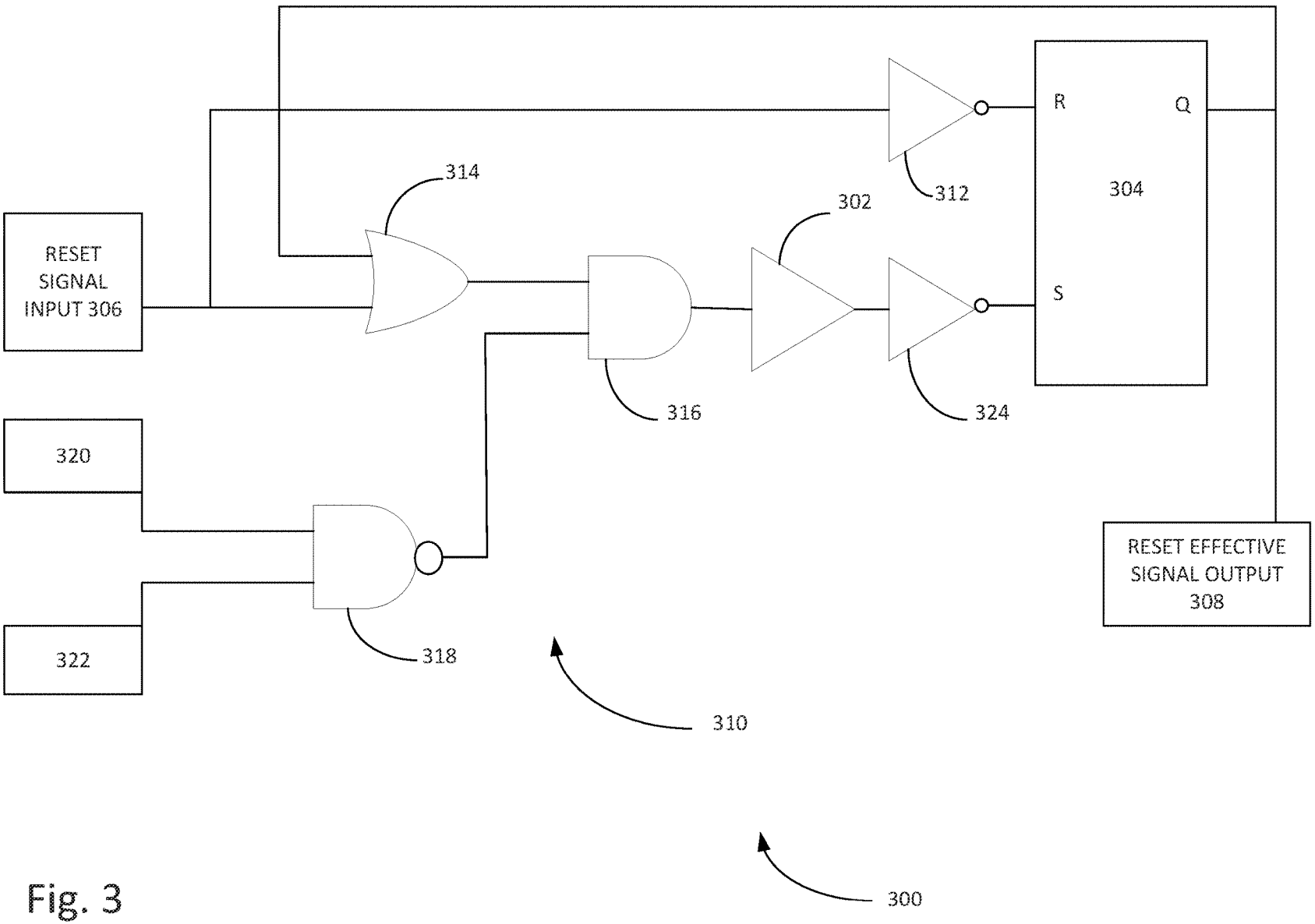
FIG. 3 is a block diagram illustrating an example monitoring circuit that can be included in the integrated circuit of FIG. 1.

FIG. 3 illustrates an example monitor circuit 300, which can be included in monitor circuit 202 of integrated circuit 200. In one example, monitor circuit 300 includes a timer 302 and a latch 304. The monitor circuit 300 is operably coupled to a reset signal input 306 that is configured to receive a reset signal and is operably coupled to a reset effective signal output 308 that is configured to provide a reset effective signal. For example, the reset signal input 306 can correspond with input 206 of integrated circuit 200 and reset effective signal output 308 can correspond with output 210 of integrated circuit 200. The monitor circuit 300 can also include a set of logic elements 310 that can receive signals including the reset signal from reset signal input 306 and the reset effective signal from the reset effective signal output 308. In the example, the reset effective signal output 308 of monitor circuit 302 can be operably coupled to control logic 216 of integrated circuit 200 to indicate whether the integrated circuit is prepared for the non-reset operating condition.

The timer 302 can include an analog circuit such as a resistor-capacitor circuit. The resistor-capacitor (RC) circuit can receive an input signal at a weak P transistor and a strong N transistor, which are operably coupled to an inverter circuit. In this example, the timer 302 operates as a delay buffer or an RC delay circuit that delays the input signal for a selected duration. The input signal to the timer 302 is provided as an output of the timer 302 after the selected duration. The selection of the circuit elements in the RC circuit can determine the length of delay of the signal input to the timer 302 to the output of the timer 302. In this configuration, the timer 302 delays transitions from logic high to logic low, i.e., falling voltage levels, for the selected duration, which can be on the order a few microseconds. Transitions from logic low to logic high, i.e., rising voltage levels, are quickly passed through the timer 302, on the order of a few nanoseconds. In the example, a reset signal can be activated with a logic low voltage and deactivated with a logic high signal. Thus, an activated reset signal received at reset signal input 306 transitions from logic high to logic low, and is passed through the timer 302 at the selected duration. A deactivated reset signal at reset signal input 306 transitions from logic low to logic high, and is passed through the timer 302 at a rate relatively faster than the selected duration.

The latch 304 in the example is a NOR-based S/R latch having set input S and reset input R. The latch 304 can include an output Q to provide the reset effective signal and is operably coupled to the reset effective signal output 308. In the example, the output Q is logic low if the S and R inputs are both set, such as both at logic high. If reset input R transitions to logic low while set input S is logic high, the output Q becomes logic high. Other latches can be used, such as NAND-based S/R latches, but with some combination of a different configuration of logic elements, different logic signals indicating an activated reset signal or an activated reset effective signal, or different inputs to the set input S and reset input R than that illustrated in the example monitor circuit 300.

The logic elements 310 can be configured such that if the reset signal at reset signal input 306 is activated, the signal provided to the reset R of the latch is logic high, or logic 1, which causes the output Q to be logic low, or logic 0. A logic low at output Q in the example is a deactivated reset effective signal and is provided to reset effective signal output 308 to indicate to logic circuit 216 that the integrated circuit 200 is not prepared for the non-reset operating condition.

If the reset signal at reset signal input 306 is deactivated prior to the selected duration, such as the reset signal transitions from logic low to logic high before the timer 302 expires, logic high signal is passed through the timer 302 relatively quickly, and the set input S does not receive a logic high signal, i.e., the set input S receives a logic low signal. Although the reset input R receives a logic low signal, the latch 304 does not set, which causes the output Q to be logic low. The logic low at output Q in the example is a deactivated reset effective signal and is provided to reset effective signal output 308 to indicate to logic circuit 216 that the integrated circuit 200 is not prepared for the non-reset operating condition.

If the reset signal at reset signal input 306 remains activated at or subsequent the selected duration, such as the reset signal remains at logic low at or after the timer 302 expires, the logic low signal is passed through the timer 302. The set input S receives the logic high signal. The reset input R continues to receive the logic high signal, which controls the latch 304, and thus causes the output Q to be logic low. The logic low at output Q in the example is a deactivated reset effective signal and is provided to reset effective signal output 308 to indicate to logic circuit 216 that the integrated circuit 200 is not prepared for the non-reset operating condition.

Once the reset signal at reset signal input 306 has been deactivated at or subsequent the selected duration, such as the reset signal transitions to the logic high at or after the timer 302 expires, a set input S receives a logic high signal and the reset input R receives a logic low signal. This configuration causes the latch 304 to set and the output Q becomes logic high. The logic high at output Q in the example is an activated reset effective signal and is provided to reset effective signal output 308 to indicate to logic circuit 216 that the integrated circuit 200 is now prepared for the non-reset operating condition. The logic circuit 216 can initiate the non-reset operating condition upon a deactivated reset signal and an activated reset effective signal.

In one example, the disclosed operations of the timer 302 and latch 304 with the reset signal at reset signal input 306 and reset effective signal at reset effective signal output 308 are implemented with a set of logic gates 310. Other sets of logic gates 310 are possible. The logic gates 310 are configure to provide a logic high signal to the reset input R when the reset signal is activated at logic low. The logic high signal is provided to the reset input R until the reset signal is deactivated. The logic gates 310 also provide a logic low to the set input S once the reset signal is activated and if the reset signal is deactivated prior to the expiration of the timer 302. If the reset signal is deactivated after the expiration of the timer 302, the logic gates 310 provide a logic low to the reset input R while the logic gates 310 continue to provide a logic high to the set input S.

In the example configuration, the reset signal input 306 is operably coupled to an input of NOT gate 312 that includes an output provided to the reset input R of latch 304. Additionally, the reset signal input 306 and reset effective signal output 308 are operably coupled to an OR gate 314. In one example, the output of the OR gate 314 can be provided to the timer 302. In the illustrated example, the output of the OR gate 314 is provided to an input of an AND gate 316. Another input of the AND gate 316 is received from a NAND gate 318, that can receive signals that are logic low or deactivated during the reset condition. For example, the NAND gate 318 can receive signals that are used to generate firing events, such as a fire signal 320 and fire signal monitor 322. The fire signal 320 and fire signal monitor 322 are typically deactivated during the reset condition. The output of the timer 302 is provided to an input of a NOT gate 324 that includes an output provided to the set input S of latch 304.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. An integrated circuit for a fluid ejection device, the fluid ejection device including a plurality of actuators to operate during a non-reset operating condition, the integrated circuit comprising:

a reset input to receive a reset signal activated for a duration wherein the reset signal generates a reset condition in the integrated circuit;

a monitor circuit operably coupled to the reset input to indicate if the duration of the reset signal meets or exceeds a selected duration; and a nonvolatile memory device having data accessible during the reset condition.

2. The integrated circuit of claim 1 wherein the data includes integrated circuit configuration data.

3. The integrated circuit of claim 1 wherein the nonvolatile memory device is operably coupled to a latch to receive the data.

4. The integrated circuit of claim 3 wherein the selected duration allows the latch to receive the data from the nonvolatile memory device.

5. The integrated circuit of claim 3 wherein the latch is included in the monitor circuit.

6. The integrated circuit of claim 1 wherein the memory device is operably coupled to a control logic to access the data during reset condition.

7. The integrated circuit of claim 6 wherein the control logic includes a regulator to transition the integrated circuit from a high current state to access the data and a low current state.

8. The integrated circuit of claim 7 wherein the regulator is a current regulator.

9. The integrated circuit of claim 1 wherein the monitor circuit includes an analog timer.

10. The integrated circuit of claim 9 wherein the analog timer includes a resistor-capacitor circuit.

11. The integrated circuit of 1 wherein the actuators are driven in response to a fire signal, and wherein the reset condition blocks the fire signal from the actuators.

12. The integrated circuit of claim 1 wherein the monitor circuit indicates the duration of the reset signal meets or exceeds a selected duration with a reset effective signal.

13. An integrated circuit for a fluid ejection device, the fluid ejection device including a plurality of actuators to operate during a non-reset operating condition, the integrated circuit comprising:

control logic operably coupled to the actuators to selectively initiate the non-reset operating condition and a reset condition, the control logic to receive a reset signal activated for a duration;

a monitor circuit to receive the reset signal and provide to the control logic a reset-effective signal if the duration of the reset signal meets or exceeds a selected duration to initiate the non-reset operating condition; and a nonvolatile memory device having data accessible to the control logic during the reset condition to configure the control logic.

14. The integrated circuit of claim 13 wherein the actuator ejects the print substance in response to a fire signal and the reset condition blocks the fire signal from the actuator.

15. The integrated circuit of claim 13 wherein the monitor circuit indicates the duration of the reset signal meets or exceeds a selected duration with a reset effective signal.

16. The integrated circuit of claim 13 wherein the control logic accesses the data in the nonvolatile memory device with a sense amplifier and a bias current, the bias current provided during the reset condition and not provided during the non-reset operating condition.

17. The integrated circuit of claim 13 wherein the control logic starts a current regulator or voltage regulator during the reset condition to read the data in the memory device.

18. The integrated circuit of claim 13 wherein the resent signal is received from an external source.

* * * * *